United States Patent [19]

Fulton

[11] 4,103,898

[45] Aug. 1, 1978

[54] BOARD GAME

[75] Inventor: Frank F. Fulton, Las Vegas, Nev.

[73] Assignee: The Raymond Lee Organization, Inc., New York, N.Y. ; a part interest

[21] Appl. No.: 794,109

[22] Filed: May 5, 1977

[51] Int. Cl.[2] ..... A63F 3/00

[52] U.S. Cl. ..... 273/248

[58] Field of Search .... 273/134 AD, 134 D, 134 CA, 273/134 AG, 134 DB

[56] References Cited

U.S. PATENT DOCUMENTS

| | | | |
|---|---|---|---|
| 1,304,431 | 5/1919 | Williams | 273/134 AD |
| 2,750,193 | 6/1956 | Wales | 273/134 AD |

*Primary Examiner*—Richard C. Pinkham
*Assistant Examiner*—Harry G. Strappello
*Attorney, Agent, or Firm*—Daniel Jay Tick

[57] ABSTRACT

A game board has a plurality of equally dimensioned squares thereon in rows and columns constituting five sets of 36 squares, each set having the same indications as the others, but in different locations on the board. Each set has 36 different cattle brands each in a corresponding one of its squares. Each of the corners has a square larger than the others which is identified as the home ranch of a specific color different from the colors of the other home ranches. Four groups of miniature plastic calves are provided. Each group has a plurality of calves of the same color, different from the colors of the other groups. Four pairs of dice are provided. Each die has six surfaces, of which two are blank and the remaining four have 1, 2, 3 and 4 dots thereon, respectively. Each pair of dice has the same color, different from the colors of the other pairs.

1 Claim, 3 Drawing Figures

BOARD GAME

BACKGROUND OF THE INVENTION

The present invention relates to a board game.

Objects of the invention are to provide a board game of simple structure, which is inexpensive in manufacture, and provides considerable entertainment, amusement, interest and recreation for players and onlookers.

BRIEF DESCRIPTION OF THE DRAWINGS

In order that the invention may be readily carried into effect, it will now be described with reference to the accompanying drawings, wherein.

DETAILED DESCRIPTION OF THE INVENTION

The board game of the invention comprises a game board 1 of square shape having a plurality of equally dimensioned squares 2, 3, 4, 5, 6, 7, 8, 9, 10, 11, 12, 13, 14, 15, 16, 17, and so on, thereon in rows and columns. The squares constitute five sets of 36 squares, as hereinafter described. Each set has the same indications as the others, but in different locations on the board. Each set of 36 squares has 36 different cattle brands, each in a corresponding one of its squares.

Figure 1:
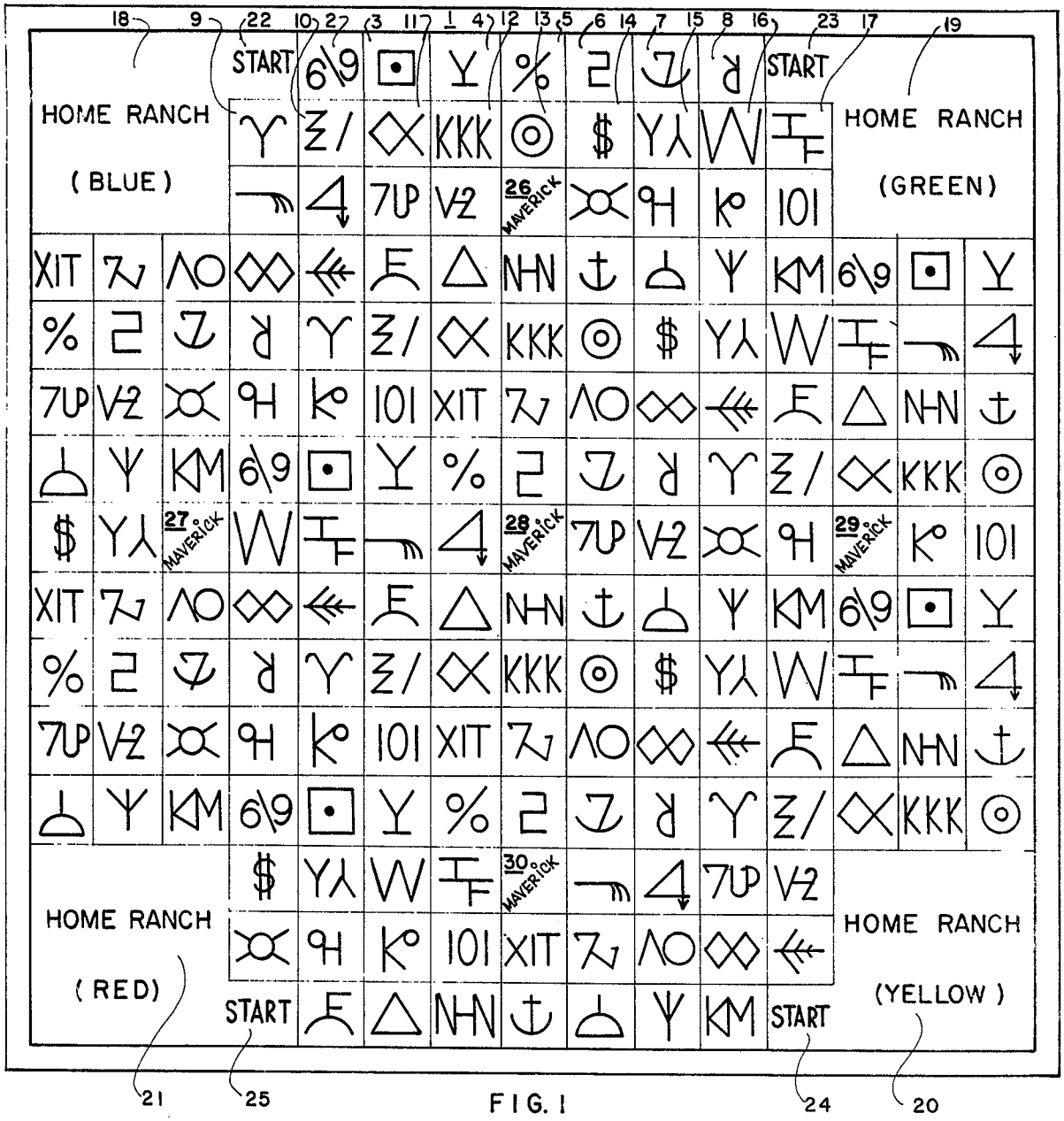
FIG. 1 is a plan view of an embodiment of the game board of the board game of the invention.

As shown in FIG. 1, the first set of squares has 36 different cattle brands in the first four rows of the game board 1, except for the last three squares on the right of the fourth row. The second set of squares, having the same 36 cattle brands in the same sequence appears in the last three squares of the fourth row, the full fifth row, the full sixth row and the first three squares on the left of the seventh row. The third set of 36 squares has the same 36 cattle brands therein in the same sequence and appears in the seventh row, except for the first three squares on the right, the eighth row, and the ninth row, with the exception of the last three squares on the left. The fourth set of cattle brands appears in the same sequence in the 36 squares beginning with the last three squares of the ninth row and extends throughout the entire 10th and 11th rows and the first three squares on the left of the 12th row. The fifth set of squares appears in the 12th, 13th, 14th and 15th rows with the exception of the first three squares on the left of the 12th row, and includes the same cattle brands in the same sequence as the previous sets.

Four corner squares 18, 19, 20 and 21 are provided at each of the corners. Each of the corner squares 18 to 21 has the dimensions of none of the previously described squares. Each of the corner squares 18 to 21 is identified as the home ranch of a specific color different from the colors of the other home ranches. Thus, the corner square 18 is the blue home ranch, the corner square 19 is the green home ranch, and the corner square 20 is the yellow home ranch and the corner square 21 is the red home ranch.

Four START squares 22, 23, 24 and 25 of the same dimensions as the plurality of squares are provided. The START square 22 is adjacent the blue home ranch 18 and appears as the first square in the first row, thereby being the first row, fourth column square. The START square 23 is next-adjacent the green home ranch 19 and is the last square of the first row, so that it is the first row, 12th column square. The START square 24 is next-adjacent the yellow home ranch 20 and is the last square of the 15th row, so that it is the square of the 15th row, 12th column. The START square 25 is next-adjacent the red home ranch 21 and is in the first square of the 15th row, whereby it is the square of the 15th row, fourth column.

Five MAVERICK squares 26, 27, 28, 29 and 30, of the same dimensions as the plurality of squares, are provided in different locations on the board. The MAVERICK square 26 is thus in the third row, eighth column square. The MAVERICK square 27 is in the eighth row, third column square. The MAVERICK square 28 is in the eighth row, eighth column square. The MAVERICK square 29 is in the eighth row, 13th column square. The MAVERICK 30 is in the 13th row, eighth column square.

Figure 2:
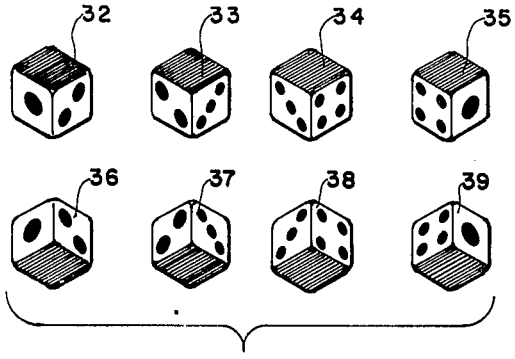
FIG. 2 is a perspective view of the four pairs of dice of the board game of the invention.
Figure 3:
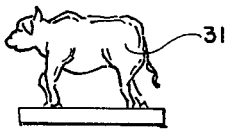
FIG. 3 is a view of a miniature plastic calf of the board game of the invention.

Four groups of miniature plastic calves, of which one calf 31 is shown in FIG. 3, are provided. Each group has a plurality of calves of the same color, different from the colors of the other groups. Thus, the first group of calves is blue, the second group of calves is green, the third group of calves is yellow and the fourth group of calves is red. Four pairs of dice, as shown in FIG. 2, are provided. Each die 32, 33, 34, 35, 36, 37, 38 and 39, has six surfaces, two of which are blank and the remaining four of which has 1, 2, 3 and 4 dots thereon, respectively. The pairs of dice 32 and 36, 33 and 37, 34 and 38, and 35 and 39 are blue, green, yellow and red, respectively. Thus, each of the four players has a home ranch, a group of calves and a pair of dice of the same color.

The 36 cattle brands of each of the five sets of cattle brands appear in the sequence, from left to right, as the Six Slash Nine, Box Dot, Why T, O Slash O, Square S, Rocking 7, Crazy Reverse R, Hooked Y, Z Z Slash, Diamond and a Half, Triple K, Double Circle, Dollar Sign, Y Up Y Down, Long W, Lazy H F, Rake, Four Spear, Seven U P, V Bar 2, Mill Iron, Nine H, K O, Hundred and One, X I T, Seven Lazy Seven, Open A O, Double Diamond, Elk Horn, F Quarter Circle, Triangle, N Bar N, Anchor, Stirrup, Turkey Track, and K M Connected.

Each player selects his or her color and acquires five calves of his or her color, corresponding to his or her home ranch color. Each player also acquires a set of dice of the same color as his or her home ranch. Each players selects a brand, from the list of 36 brands, which he or she will be playing for. Each player may use the same brand, or select a different one for the following game.

The object of the game is to be the first cowboy or the first cowgirl to have all five calves branded. In other words, the object of the game is to move each of the five calves from their home ranch to the squares bearing the brand selected by the player. When a player has all five of his or her calves in each of the squares listing the selected brand, he or she must then return them to the home ranch. All five calves must be branded before any of them may be returned to their home ranch.

A high roll of the dice starts the game. The dice are rolled until one of the four players is the high winner. Such player starts the action.

No player may stop on a START square. It requires a roll of at least 2 to get a calf out or a roll of at least 3 to get a calf into its home ranch.

A player may make a right angle turn only in the START row, entering on the way out from the home ranch, or returning to the home ranch. All other plays must be in the direction of a row or column. A player may elect to pass on any roll of his dice, but loses his turn.

Whenever a player lands on a MAVERICK square, he wins another roll of the dice.

On a double roll of fours, for a total of 8, a player may split the roll, 1-7, 2-6, 3-5, 4-4. A player may not split a roll at any other time.

A player may not, at any time, count over a square bearing a calf, be it his or another player's. Such square must always be played around.

When a calf is removed from the START square, the count is 1. When a calf is returned home, the START square provides a count of 1 and the home ranch provides a count of 1. In other words, if a player is returning a calf to its home ranch and is three squares away from the corresponding START square, he or she needs a roll of 5 on the dice to get home. This is computed as 3 for the three squares, 1 for the START square and 1 for the home square.

While the invention has been described by means of a specific example and in a specific embodiment, I do not wish to be limited thereto, for obvious modifications will occur to those skilled in the art without departing from the spirit and scope of the invention.

I claim:

1. A board game, comprising a game board of square shape having a plurality of equally dimensioned squares thereon in rows and columns, said squares constituting five sets of 36 squares each, each set having the same indications as the others, but in different locations on the board, each set having 36 different cattle brands each in a corresponding one of its squares, four corner squares larger than each of the plurality of squares, each of the corner squares being identified as the home ranch of a specific color different from the colors of the other home ranches, four START squares of the same dimensions as the plurality of squares, each of said START squares being next adjacent a corresponding one of the corner squares, five MAVERICK squares of the same dimensions as the plurality of squares in different locations on the board;

four groups of miniature plastic calves, each group having a plurality of calves of the same color different from the colors of other groups; and four pairs of dice, each die having six surfaces, two blank and the remaining four having 1, 2, 3 and 4 dots thereon, respectively, each pair of dice having the same color different from the colors of the other pairs, the colors of the home ranches, the calves and the dice corresponding so that each of the four players has a home ranch, a group of calves and a pair of dice of the same color.

* * * * *